US012173565B2

(12) United States Patent
Gomez

(10) Patent No.: US 12,173,565 B2
(45) Date of Patent: Dec. 24, 2024

(54) SYSTEM AND APPARATUS FOR RELEASE AND ROTATION OF ROD LIFT STRING

(71) Applicant: SAUDI ARABIAN OIL COMPANY, Dhahran (SA)

(72) Inventor: Felix Andres Cepeda Gomez, Dhahran (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 0 days.

(21) Appl. No.: 18/153,284

(22) Filed: Jan. 11, 2023

(65) Prior Publication Data

US 2024/0229568 A1 Jul. 11, 2024

(51) Int. Cl.
*E21B 17/06* (2006.01)
*E21B 17/05* (2006.01)

(52) U.S. Cl.
CPC ..... *E21B 17/05* (2013.01); *E21B 17/06* (2013.01)

(58) Field of Classification Search
CPC ..... E21B 17/05; E21B 17/06
See application file for complete search history.

(56) References Cited

U.S. PATENT DOCUMENTS 4,422,508 A * 12/1983 Rutledge, Jr. ..... E21B 43/127 166/376
5,139,090 A * 8/1992 Land ..... E21B 43/127 166/216
5,642,782 A * 7/1997 Grimshaw ..... E21B 33/0415 166/242.6
6,068,052 A * 5/2000 Dobbs ..... F04B 53/145 166/105.2
8,636,057 B2 1/2014 Wolodko et al.
9,045,949 B2 6/2015 Dobbs
2014/0086681 A1* 3/2014 Dobbs ..... F04B 53/145 403/375
2015/0330156 A1* 11/2015 Barannikow ..... E21B 21/02 166/242.6
2015/0368989 A1* 12/2015 Lauder ..... E21B 17/046 166/85.1
2016/0160576 A1* 6/2016 Obrejanu ..... E21B 17/1085 166/242.6

* cited by examiner

*Primary Examiner* — Taras P Bemko
(74) *Attorney, Agent, or Firm* — Vorys, Sater, Seymour and Pease LLP

(57) ABSTRACT

A shearable swivel tool for a rod lift system includes an upper coupling section, a lower coupling section operatively coupled to the upper coupling section with one or more shearable members, and a swivel housing operatively coupled to the lower coupling section and housing a swivel mechanism configured to be operatively coupled to a downhole pump of the rod lift system. The one or more shearable members are configured to fail upon assuming a predetermined shear limit resulting from an axial load assumed on the upper coupling section. The swivel mechanism is rotatable independent of the swivel housing, thereby allowing the downhole pump to rotate independent of the shearable swivel tool.

20 Claims, 3 Drawing Sheets

SYSTEM AND APPARATUS FOR RELEASE AND ROTATION OF ROD LIFT STRING

FIELD OF THE DISCLOSURE

The present disclosure relates generally to rod lift systems in oil wells and, more particularly, to tooling for enabling rotation and a safety release within a rod lift string.

BACKGROUND OF THE DISCLOSURE

When installing a rod lift system in an unconventional oil well, a full containment deployment is often required to prevent the loss of hydrocarbons for extraction. To this end, a slickline unit is commonly used to initially deploy the pump which is secured using a rod blow-out preventer (BOP). While the rod BOP will maintain the well in full containment, the engaged rams of the BOP will prevent rotating the pump to apply the required make-up torque while connecting to the rod string above the pump. As such, it may be necessary to use a nonstandard rotation tool between the pump and the rod string to overcome the limitations introduced by the rod BOP.

Moreover, in the event a pump in the rod lift system becomes stuck downhole, the rod string and the tubing string must oftentimes be removed simultaneously to retrieve the pump. The tubing string will be full of liquids (e.g., hydrocarbons), and the rod string must be cut along each tubing joint. This removal process may expose workers to sour gas, such as hydrogen sulfide, and will increase intervention times involved in the correction of the stuck pump.

Accordingly, improvements to rod lift systems are desired to ease installation and extraction, and to reduce intervention times.

SUMMARY OF THE DISCLOSURE

Various details of the present disclosure are hereinafter summarized to provide a basic understanding. This summary is not an extensive overview of the disclosure and is neither intended to identify certain elements of the disclosure, nor to delineate the scope thereof. Rather, the primary purpose of this summary is to present some concepts of the disclosure in a simplified form prior to the more detailed description that is presented hereinafter.

According to an embodiment consistent with the present disclosure, a shearable swivel tool for a rod lift system includes an upper coupling section, a lower coupling section operatively coupled to the upper coupling section with one or more shearable members, and a swivel housing operatively coupled to the lower coupling section and housing a swivel mechanism configured to be operatively coupled to a downhole pump of the rod lift system. The one or more shearable members are configured to fail upon assuming a predetermined shear limit resulting from an axial load assumed on the upper coupling section, and the swivel mechanism is rotatable independent of the swivel housing, thereby allowing the downhole pump to rotate independent of the shearable swivel tool.

In a further embodiment, a rod lift system for a well includes a beam pump assembly arranged at a wellhead, production tubing extended into a well extending from the wellhead, a rod string operatively coupled to the beam pump assembly and extendable into the production tubing within the well, a downhole pump operatively coupled to a distal end of the rod string and arranged within the production tubing, and a shearable swivel tool interposing the rod string and the downhole pump. The shearable swivel tool includes an upper coupling section providing a top connector, the distal end of the rod string being secured to the top connector, a lower coupling section operatively coupled to the upper coupling section with one or more shearable members configured to shear upon assuming a predetermined shear limit, and a swivel housing operatively coupled to the lower coupling section and housing a swivel mechanism operatively coupled to the downhole pump and a bottom connector. The predetermined shear limit is reached when the rod string applies a predefined axial load on the upper coupling section at the top connector, and shearing the one or more shearable members allows the upper coupling section to separate from the lower coupling section to retrieve the rod string while the downhole pump remains in the well.

Any combinations of the various embodiments and implementations disclosed herein can be used in a further embodiment, consistent with the disclosure. These and other aspects and features can be appreciated from the following description of certain embodiments presented herein in accordance with the disclosure and the accompanying drawings and claims.

DETAILED DESCRIPTION

Figure 1:
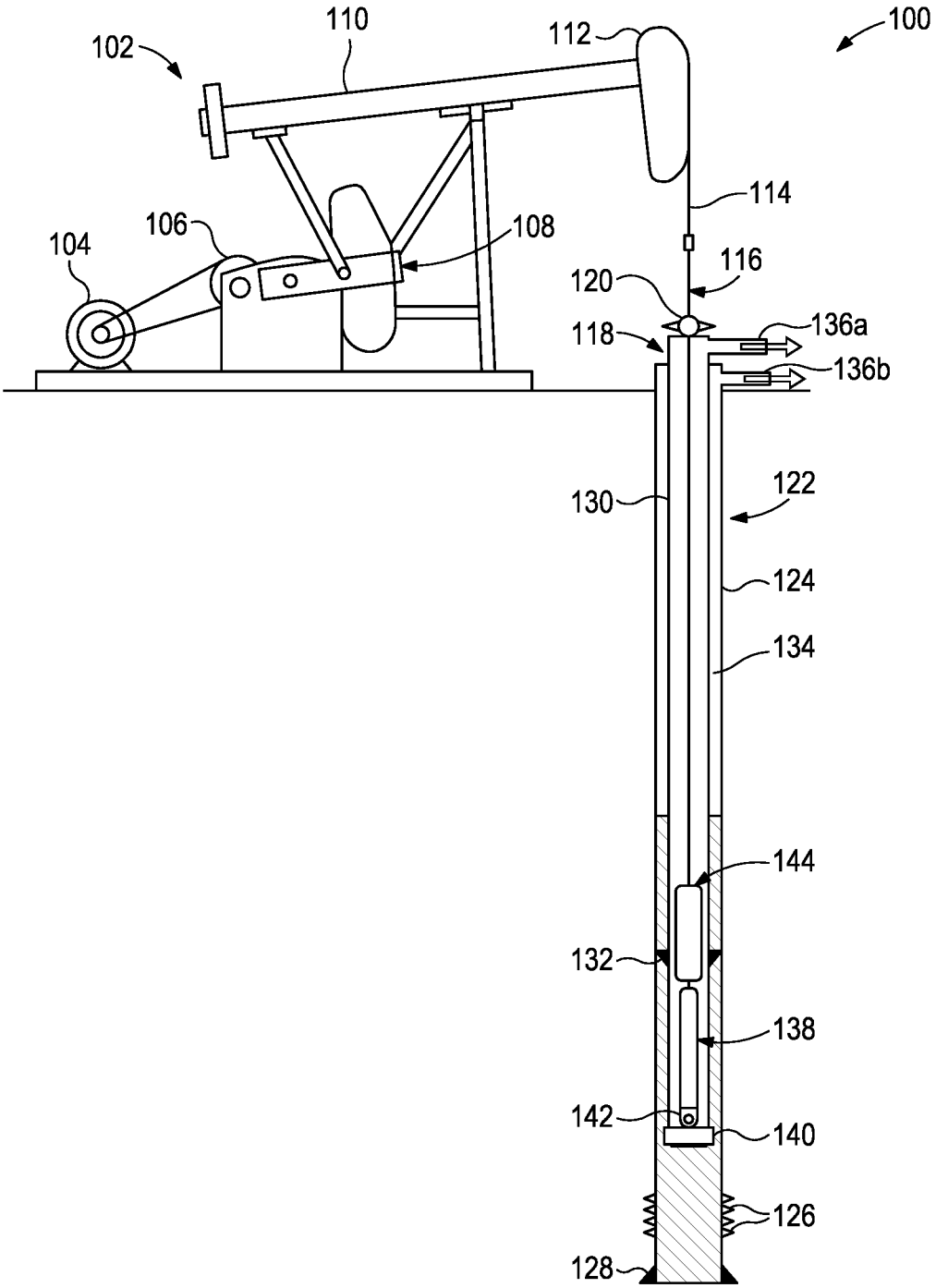
FIG. 1 is a schematic of an example rod lift system with rotational and shearing capabilities.

Embodiments of the present disclosure will now be described in detail with reference to the accompanying Figures. Like elements in the various figures may be denoted by like reference numerals for consistency. Further, in the following detailed description of embodiments of the present disclosure, numerous specific details are set forth in order to provide a more thorough understanding of the claimed subject matter. However, it will be apparent to one of ordinary skill in the art that the embodiments disclosed herein may be practiced without these specific details. In other instances, well-known features have not been described in detail to avoid unnecessarily complicating the description. Additionally, it will be apparent to one of ordinary skill in the art that the scale of the elements presented in the accompanying Figures may vary without departing from the scope of the present disclosure.

Embodiments in accordance with the present disclosure generally relate to rod lift systems in oil wells and, more particularly, to tooling for enabling rotation and a safety release within a rod lift string. The embodiments presented herein may prove advantageous in allowing proper operation of rod lift systems in unconventional wells while maintaining optimal safety and maintenance procedures for the rod lift system. The hybrid tool disclosed herein, and the associated rod lift system, may be utilized within unconventional oil/gas wells or any application requiring a full containment deployment for operation.

FIG. 1 is a schematic of an example rod lift system 100 that may incorporate one or more principles of the present disclosure. As illustrated, the rod lift system 100 (hereinafter "the system 100") includes a surface pumping mechanism in the form of a beam pump assembly 102. The beam pump assembly 102 may be driven by a prime mover 104, which may provide high-speed, low-torque power to the system 100 through an electric motor, an internal combustion engine, or any alternative power producing component. The power provided by the prime mover 104 may be transferred to a gear reducer 106 which converts the power to a low-speed, high-torque power. The gear reducer 106 may be connected to a crank arm assembly 108, which is used to drive reciprocating (rocking) motion of a beam 110. The reciprocating motion of the beam 110 correspondingly moves a horsehead 112, which is attached to one end of the beam 110. One or more cables 114 are attached to the horsehead 112 and may be raised and lowered as the crank arm assembly 108 rotates and cause the horsehead 112 to pivot up and down.

A rod string 116 may be operatively coupled to the cables 114, and the rod string 116 may be extendable within a completed oil/gas well 122 (hereinafter "the well 122"). The rod string 116 extends through a wellhead 118, which may incorporate a stuffing box 120 designed to allow the rod string 116 to reciprocate within (through) the wellhead 118 while maintaining pressure within the well 122. The wellhead 118 provides a surface cap for the well 122 and serves as an interface between the well 122 and any surface equipment. In some applications, some or all of the well 122 may be lined with casing 124 that separates the well 122 from the surrounding environment. In at least one embodiment, one or more perforations 126 may be defined in the casing 124 to provide a conduit for the entry of hydrocarbons (e.g., oil and gas) into the well 122, thus helping facilitate the extraction of the hydrocarbons by the system 100. The casing 124 may terminate with a casing shoe 128 or the like.

Production tubing 130 may be extended into the well 122 from the wellhead 118 and arranged concentric with the casing 124, thereby defining an annulus 134 between the casing 124 and the production tubing 130. The production tubing 130 provides a conduit to facilitate extraction of the hydrocarbons, and may be held in place within the casing 124 using a tubing anchor 132. Fluids (e.g., hydrocarbons) that migrate into the production tubing 130 may be extracted from the well 122 via a production outlet 136*a* provided at the wellhead 118. As needed, any fluids (e.g., gases) present within the annulus 134 may also be extracted from the well 122 via a gas outlet 136*b* provided at the wellhead 118.

Hydrocarbon extraction is initiated and controlled by the operation (motion) of the beam pump assembly 102 at the surface and a downhole pump 138 arranged within the well 122 and, more particularly, within the production tubing 130. The downhole pump 138 may be operatively coupled to a distal end of the rod string 116 and may operate based on the reciprocating motion of the rod string 116, which actuates the pumping mechanism of the downhole pump 138. As the downhole pump 138 operates, hydrocarbons that have migrated into the well 122 from the perforations 126 (or elsewhere) are pulled or drawn through a standing valve 140 and subsequently through a travelling valve 142, which communicates with an interior of the production tubing 130. Once in the production tubing 130, further reciprocation of the rod string 116 causes the downhole pump 138 to continue pumping the extracted hydrocarbons towards the surface within the production tubing 130 and to the production outlet 136*a*.

During installation of conventional rod lift systems, and especially in systems with high hydrogen sulfide ($H_2S$) content, initial deployment of the downhole pump must be done using a slickline unit to achieve full containment deployment. More particularly, the downhole pump must be secured using a rod blow out preventer (BOP), which operates to maintain the well with full containment, but fully closed BOP rams prevent the downhole pump from being rotated to apply the required make-up torque and connect the rod string above it. Consequently, in prior art systems, it is often required to use a nonstandard tool between the downhole pump and the rod string to facilitate interconnection.

Using non-standard tools is typically not recommended in combination with conventional shear couplings because it can introduce additional axial movement that can harm the entire system performance and potentially lead to premature failure of the entire rod string. In contrast, not having at least a conventional shear coupling installed at the downhole pump can cause a more expensive and dangerous condition while retrieving the production tubing in case of a stuck downhole pump. In such a scenario, the rod string would have to be retrieved along with the production tubing, which will be full of liquids (e.g., hydrocarbons), and it is necessary to cut the rod string with every tubing joint. This process increases intervention times and potentially exposes rig personnel to $H_2S$ (sour gas).

According to embodiments of the present disclosure, and to mitigate the above-described issues, the system 100 may further include a shearable swivel tool 144 interposing and operatively coupled to the rod string 116 and the downhole pump 138. As described herein, the shearable swivel tool 144 may be operable to enable independent rotation above and below the shearable swivel tool 144, and may thus enable the connection of the downhole pump 138 to the remainder of the rod string 116 while contained in a full pressure-containment scenario. Further, the shearable swivel tool 144 enables disconnection of the rod string 116 from the downhole pump 138 in the event the downhole pump 138 becomes stuck within the production tubing 130. The ability to disconnect the rod string 116 from the downhole pump 138 may allow for corrective measures to be performed in a safer and less time-consuming manner without additionally endangering the normal operation of the system 100.

Figure 2A:
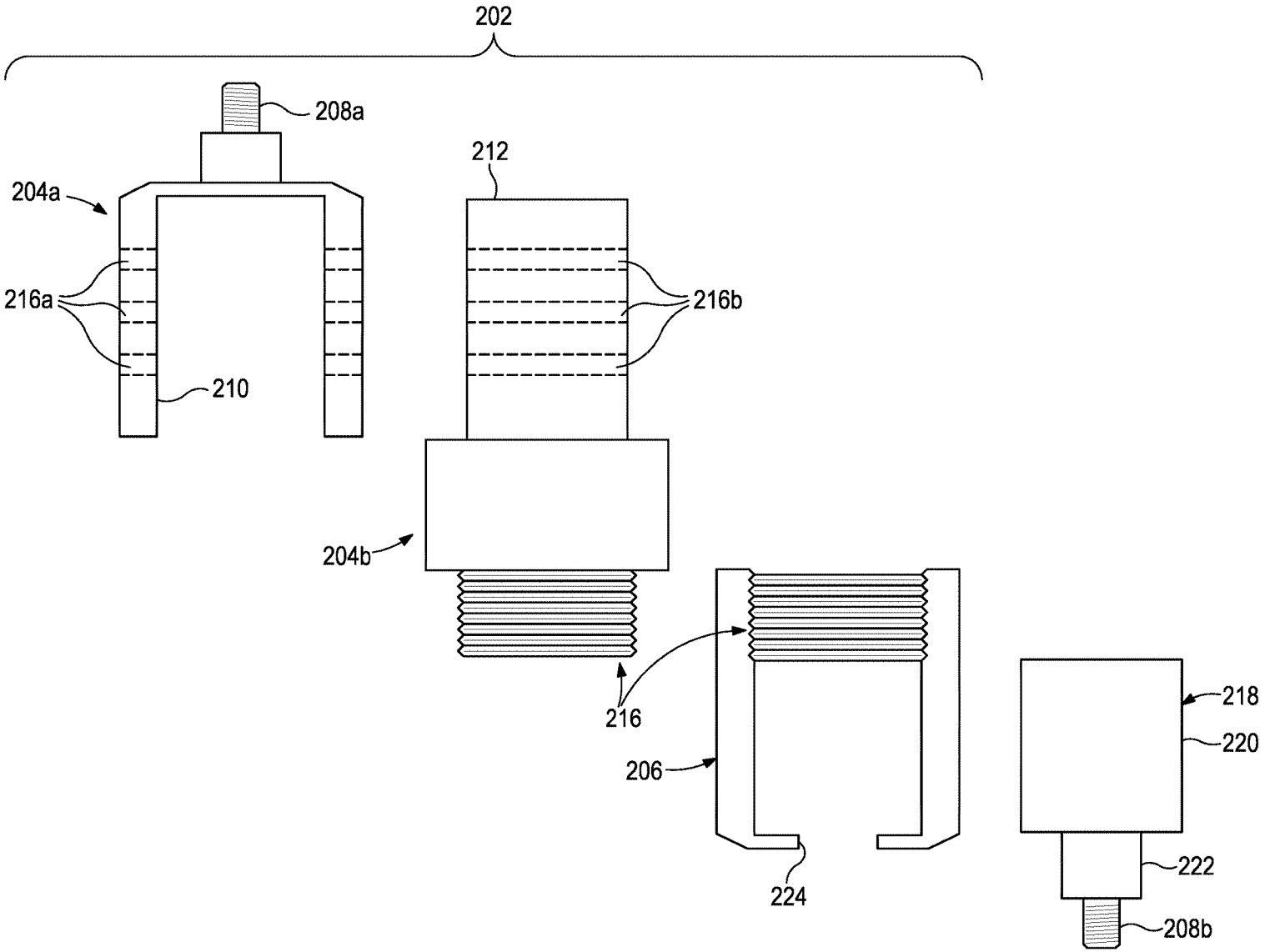
FIGS. 2A and 2B are exploded and partial cross-sectional side views, respectively, of an example of the shearable swivel tool of FIG. 1, according to one or more embodiments.
Figure 2B:
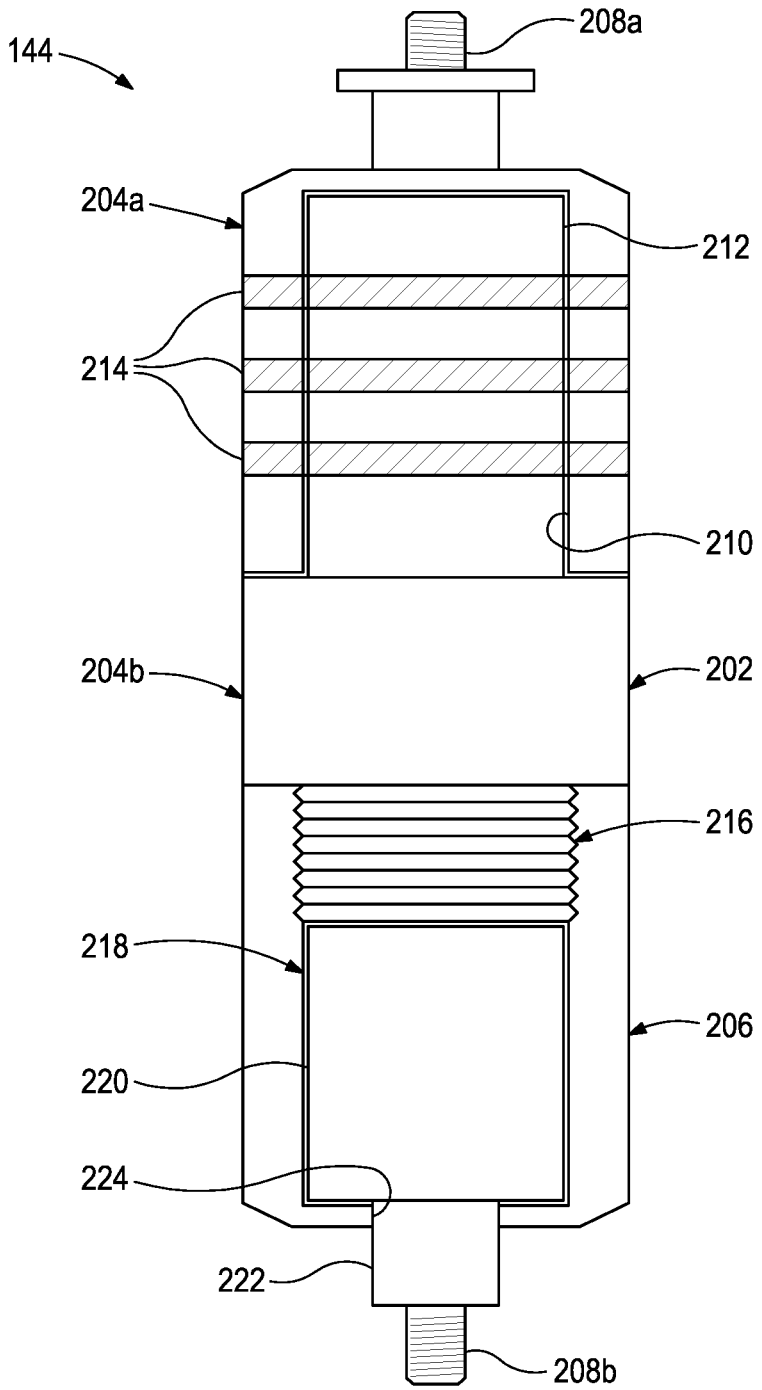

FIGS. 2A and 2B are exploded and partial cross-sectional side views, respectively, of an example of the shearable swivel tool 144, according to one or more embodiments. As illustrated, the shearable swivel tool 144 includes an elongate body 202 made up of a variety of component parts operatively coupled to each other to form the shearable swivel tool 144. In particular, the body 202 may include a first or "upper" coupling section 204*a*, a second or "lower" coupling section 204*b*, and a swivel housing 206.

The upper coupling section 204*a* may include or otherwise provide a top connector 208, which provides a location for the rod string 116 (FIG. 1) to be attached to the shearable swivel tool 144. In some embodiments, the top connector 208 may comprise a threaded interface configured to threadably engage the rod string 116. In other embodiments, however, the top connector 20806*a* may alternatively comprise other types of connection means such as, but not limited to, one or more mechanical fasteners, a bayonet connection, a J-slot connection, a welded interface, or any combination thereof.

The upper coupling section 204*a* may also define an inner chamber 210 sized to extend over and receive a portion of the lower coupling section 204*b*. More specifically, the lower coupling section 204*b* may provide and otherwise define an axial extension 212 receivable within the inner chamber 210. The upper and lower coupling sections 204*a,b* may comprise independent component parts that are operatively and releasably coupled to each other using one or more shearable members 214 (FIG. 2B) extendable through corresponding portions of the upper and lower coupling sections 204*a,b*. More specifically, the upper coupling section 204*a* may provide or define one or more first channels 216*a* (FIG. 2A), and the lower coupling section 204*b* may provide or define one or more second channels 216*b* (FIG. 2A) that are alignable with the first channels 216*a* when the axial extension 212 is received within the inner chamber 210. Once the axial extension 212 is received within the inner chamber 210, the shearable members 214 may be extended through the co-axially aligned channels 216*a,b* to thereby secure the lower coupling section 204*b* to the upper coupling section 204*a*.

The shearable members 214 may comprise any type of shearable device designed to shear or otherwise fail upon assuming a predetermined shear limit. Examples of the shearable members 214 include, but are not limited to, shear pins, shear screws, or any combination thereof. Moreover, while three shearable members 214 are depicted in FIG. 2B, more or less than three may be used in the shearable swivel tool 144, without departing from the scope of the disclosure.

The shearable members 214 may serve a dual purpose. First, the shearable members 214 may operate to mate (couple) the upper and lower coupling sections 204*a,b* for downhole use. Second, the shearable members 214 may be configured to shear or otherwise fail upon assuming a predetermined shear limit resulting from the shearable swivel tool 144 assuming a predefined overpull value or axial (tensile) load via the rod string 116 (FIG. 1). More specifically, if the downhole pump 138 (FIG. 1) becomes stuck within the well 122 (FIG. 1) and, more particularly, within the production tubing 130 (FIG. 1), the rod string 116 may be separated from the downhole pump 138 by applying an axial (tensile) load on the shearable swivel tool 144 at the top connector 208*a*. The axial load may be assumed by the shearable members 214, and once the predetermined shear limit of the shearable members 214 is reached, the shearable members 214 will fail and the upper coupling section 204*a* will separate from the lower coupling section 204*b*. This will allow the rod string 116 to be extracted from the well 122 independent of the downhole pump 138 and the production tubing 130.

Once the rod string 116 and the upper coupling section 204*a* are removed from the well 122, the production tubing 130, along with the lower coupling section 204*b* and the attached downhole pump 138, may be extracted from the well. If desired, the shearable swivel tool 144 may be subsequently reconstructed at surface by re-attaching the upper coupling section 204*a* to the upper coupling section 204*a* using one or more new shearable members 214. The shearable swivel tool 144 may then be used in future downhole operations, as desired.

Still referring to FIGS. 2A-2B, the lower coupling section 204*b* may be operatively coupled to and otherwise matable with the swivel housing 206. In some embodiments, as illustrated, the swivel housing 206 may be threaded to the lower coupling section 204*b* at a threaded interface 216. In other embodiments, however, the threaded interface 216 may be replaced with any other type of coupling means capable of operatively coupling the lower coupling section 204*b* to the swivel housing 206.

In some embodiments, the shearable swivel tool 144 may further include a swivel mechanism 218 rotatably mounted to the swivel housing 206. More specifically, the swivel mechanism 218 may provide a head 220 and a stem 222 extending from the head 220. The head 220 may be sized to be received within the swivel housing 206, and the stem 222 may be configured to extend through an aperture 224 defined in the lower end of the swivel housing 206. In some embodiments, a bottom connector 208*b* may be provided by and otherwise extend from the swivel mechanism 218 and, more particularly, from the stem 222. The bottom connector 208*b* provides a location for the shearable swivel tool 144 to be attached to the downhole pump 138 (FIG. 1), or to any additional downhole tooling utilized in the system 100 of FIG. 1. Similar to the top connector 208*a*, the bottom connector 208*b* may comprise a threaded interface, but could alternatively comprise other types of connection means such as, but not limited to, one or more mechanical fasteners, a bayonet connection, a J-slot connection, a welded interface, or any combination thereof.

The head 220 may be loosely arranged within the swivel housing 206 and otherwise provided with a predetermined clearance, thus allowing the swivel mechanism 218 to rotate (swivel) independent of the swivel housing 206, and without affecting the mating at the threaded engagement 216. Consequently, operatively coupling the downhole pump 138 (FIG. 1) to the bottom connector 208*b* allows the swivel mechanism 218 and the interconnected downhole pump 138 to rotate independent of the body 202 and any tooling operatively coupled to the shearable swivel tool 144 at the upper connector 208*a*. In some embodiments, further tooling (e.g., a bearing or bushing) may be included within the clearance defined between the swivel housing 206 and the head 220, which may reduce friction during operation.

The terminology used herein is for the purpose of describing particular embodiments only and is not intended to be limiting of the invention. As used herein, for example, the singular forms "a," "an," and "the" are intended to include the plural forms as well, unless the context clearly indicates otherwise. It will be further understood that the terms "contains", "containing", "includes", "including," "comprises", and/or "comprising," and variations thereof, when used in this specification, specify the presence of stated features, integers, steps, operations, elements, and/or components, but do not preclude the presence or addition of one or more other features, integers, steps, operations, elements, components, and/or groups thereof.

Terms of orientation are used herein merely for purposes of convention and referencing and are not to be construed as limiting. However, it is recognized these terms could be used with reference to an operator or user. Accordingly, no limitations are implied or to be inferred. In addition, the use of ordinal numbers (e.g., first, second, third, etc.) is for distinction and not counting. For example, the use of "third" does not imply there must be a corresponding "first" or "second." Also, if used herein, the terms "coupled" or "coupled to" or "connected" or "connected to" or "attached" or "attached to" may indicate establishing either a direct or indirect connection, and is not limited to either unless expressly referenced as such.

While the disclosure has described several exemplary embodiments, it will be understood by those skilled in the art that various changes can be made, and equivalents can be substituted for elements thereof, without departing from the spirit and scope of the invention. In addition, many modifications will be appreciated by those skilled in the art to adapt a particular instrument, situation, or material to embodiments of the disclosure without departing from the essential scope thereof. Therefore, it is intended that the invention not be limited to the particular embodiments disclosed, or to the best mode contemplated for carrying out this invention, but that the invention will include all embodiments falling within the scope of the appended claims. Moreover, reference in the appended claims to an apparatus or system or a component of an apparatus or system being adapted to, arranged to, capable of, configured to, enabled to, operable to, or operative to perform a particular function encompasses that apparatus, system, or component, whether or not it or that particular function is activated, turned on, or unlocked, as long as that apparatus, system, or component is so adapted, arranged, capable, configured, enabled, operable, or operative.

The invention claimed is:

1. A shearable swivel tool for a rod lift system, comprising:

an upper coupling section;

a lower coupling section operatively coupled to the upper coupling section with one or more shearable members; and a swivel housing threadably mated to the lower coupling section at a threaded interface and housing a swivel mechanism configured to be operatively coupled to a downhole pump of the rod lift system, wherein the one or more shearable members are configured to fail upon assuming a predetermined shear limit resulting from an axial load assumed on the upper coupling section, and wherein the swivel mechanism is rotatable independent of the swivel housing, thereby allowing the downhole pump to rotate independent of the shearable swivel tool.

2. The shearable swivel tool of claim 1, further comprising a top connector extending from the upper coupling section to be secured to a rod string of the rod lift system, wherein the axial load is applied at the top connector by the rod string.

3. The shearable swivel tool of claim 1, wherein the swivel mechanism includes:

a head sized to be received within the swivel housing;

a stem extending from the head and through an aperture defined in the swivel housing; and a bottom connector extending from the stem and operatively coupling the swivel mechanism to the downhole pump.

4. The shearable swivel tool of claim 3, wherein the head is loosely arranged within the swivel housing, thus allowing the swivel mechanism to rotate independent of the swivel housing.

5. The shearable swivel tool of claim 1, wherein the upper coupling section defines an inner chamber and the lower coupling section provides an axial extension sized to be received within the inner chamber, and wherein the one or more shearable members extend through the upper coupling section and the axial extension to operatively couple the upper and lower coupling sections.

6. The shearable swivel tool of claim 5, further comprising:

one or more first channels defined in the upper coupling section; and one or more second channels defined in the axial extension, wherein the one or more first channels co-axially align with the one or more second channels when the axial extension is received within the inner chamber.

7. The shearable swivel tool of claim 1, wherein the one or more shearable members comprise a shearable device selected from the group consisting of a shear pin, a shear screw, and any combination thereof.

8. A rod lift system for a well, comprising:

a beam pump assembly arranged at a wellhead;

production tubing extended into a well extending from the wellhead;

a rod string operatively coupled to the beam pump assembly and extendable into the production tubing within the well;

a downhole pump operatively coupled to a distal end of the rod string and arranged within the production tubing; and a shearable swivel tool interposing the rod string and the downhole pump, the shearable swivel tool including:

an upper coupling section providing a top connector, the distal end of the rod string being secured to the top connector;

a lower coupling section operatively coupled to the upper coupling section with one or more shearable members configured to shear upon assuming a predetermined shear limit; and a swivel threadably mated to the lower coupling section at a threaded interface and housing a swivel mechanism operatively coupled to the downhole pump and a bottom connector, wherein the predetermined shear limit is reached when the rod string applies a predefined axial load on the upper coupling section at the top connector, and wherein shearing the one or more shearable members allows the upper coupling section to separate from the lower coupling section to retrieve the rod string while the downhole pump remains in the well.

9. The rod lift system of claim 8, wherein one or both of the top connector and the bottom connector comprise a connection selected from the group consisting of a threaded interface, one or more mechanical fasteners, a bayonet connection, a J-slot connection, a welded interface, and any combination thereof.

10. The rod lift system of claim 8, wherein the upper coupling section defines an inner chamber and the lower coupling section provides an axial extension sized to be received within the inner chamber, and wherein the one or more shearable members extend through the upper coupling section and the axial extension to operatively couple the upper and lower coupling sections.

11. The rod lift system of claim 10, further comprising:

one or more first channels defined in the upper coupling section; and one or more second channels defined in the axial extension, wherein the one or more first channels co-axially align with the one or more second channels when the axial extension is received within the inner chamber.

12. The rod lift system of claim 8, wherein the swivel mechanism is rotatable independent of the swivel housing, thereby allowing the downhole pump to rotate independent of the shearable swivel tool.

13. The rod lift system of claim 8, wherein the swivel mechanism includes:

a head sized to be loosely received within the swivel housing; and a stem extending from the head and through an aperture defined in the swivel housing, wherein the bottom connector extends from the stem.

14. A shearable swivel tool for a rod lift system, comprising:

an elongate body, the elongate body comprising:

an upper coupling section defining a top connector mateable to a rod string of the rod lift system;

a lower coupling section operatively coupled to the upper coupling section with one or more shearable members; and a swivel threadably mated to the lower coupling section at a threaded interface; and a swivel mechanism at least partially housed within the swivel housing and configured to be operatively coupled to a downhole pump of the rod lift system, wherein the swivel mechanism is rotatable independent of the swivel housing, thereby allowing the downhole pump to rotate independent of the shearable swivel tool.

15. The shearable swivel tool of claim 14, wherein the swivel mechanism includes:

a head sized to be received within the swivel housing;

a stem extending from the head and through an aperture defined in the swivel housing; and a bottom connector extending from the stem and operatively coupling the swivel mechanism to the downhole pump.

16. The shearable swivel tool of claim 15, wherein the head is loosely arranged within the swivel housing, thus allowing the swivel mechanism to rotate independent of the swivel housing.

17. The shearable swivel tool of claim 15, wherein one or both of the top connector and the bottom connector comprise a connection selected from the group consisting of a threaded interface, one or more mechanical fasteners, a bayonet connection, a J-slot connection, a welded interface, and any combination thereof.

18. The shearable swivel tool of claim 14, wherein the upper coupling section defines an inner chamber and the lower coupling section provides an axial extension sized to be received within the inner chamber, and wherein the one or more shearable members extend through the upper coupling section and the axial extension to operatively couple the upper and lower coupling sections.

19. The shearable swivel tool of claim 18, further comprising:

one or more first channels defined in the upper coupling section; and one or more second channels defined in the axial extension, wherein the one or more first channels co-axially align with the one or more second channels when the axial extension is received within the inner chamber.

20. The shearable swivel tool of claim 14, wherein the one or more shearable members comprise a shearable device selected from the group consisting of a shear pin, a shear screw, and any combination thereof.

* * * * *